US007442063B2

(12) United States Patent
Sabo et al.

(10) Patent No.: US 7,442,063 B2
(45) Date of Patent: Oct. 28, 2008

(54) CARD EDGE CONNECTOR

(75) Inventors: James M. Sabo, Harrisburg, PA (US); Kevin E. Walker, Hershey, PA (US); Brian J. Gillespie, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 147 days.

(21) Appl. No.: 11/605,538

(22) Filed: Nov. 28, 2006

(65) Prior Publication Data

US 2007/0123076 A1 May 31, 2007

Related U.S. Application Data

(60) Provisional application No. 60/740,472, filed on Nov. 28, 2005.

(51) Int. Cl.
*H01R 11/22* (2006.01)

(52) U.S. Cl. ..... 439/267; 439/157; 439/260

(58) Field of Classification Search ..... 439/260, 439/267, 157

See application file for complete search history.

(56) References Cited

U.S. PATENT DOCUMENTS

| | | | | |
|---|---|---|---|---|
| 3,982,807 | A * | 9/1976 | Anhalt et al. | 439/260 |
| 4,487,468 | A * | 12/1984 | Fedder et al. | 439/635 |
| 4,553,803 | A * | 11/1985 | Lapraik et al. | 439/267 H |
| 4,611,870 | A * | 9/1986 | Beers | 439/263 |
| 4,613,193 | A * | 9/1986 | Beers | 439/59 |
| 5,002,496 | A * | 3/1991 | Fox, Jr. | 439/260 |
| 6,431,890 | B1 * | 8/2002 | Li et al. | 439/160 |
| 7,014,487 | B2 * | 3/2006 | Ishikawa | 439/267 |
| 7,338,303 | B1 * | 3/2008 | Yi et al. | 439/267 |

* cited by examiner

*Primary Examiner*—Briggitte R Hammond
(74) *Attorney, Agent, or Firm*—Wei Te Chung

(57) ABSTRACT

The present invention provides an electrical connector (100) comprising a housing assembly (10, 20) defining a slot, a number of contacts (30) assembled to the housing assembly (10, 20), a carriage (80) up and down moveably assembled in the slot; and a latch arm (50) being pivotally mounted to an end of the carriage (80) and being up and down moveable with the carriage (80), wherein the latch arm (50) being pivotally moveable coupled with a downward movement together with the carriage (80), in response to insertion of a daughter card into the slot, from an upper position to a lower position.

12 Claims, 17 Drawing Sheets

CARD EDGE CONNECTOR

CROSS REFERENCE TO RELATED APPLICATION

This application claims priority under 35 U.S.C. §119(e) of U.S. Provisional Patent Application No. 60/740,472 filed Nov. 28, 2005.

BACKGROUND OF THE INVENTION

1. Field of the Invention

The present invention relates to a card edge connector for an electronic card, and more particularly, to a card edge connector wherein a low or zero insertion force is applied to the electronic card when the electrical card is inserted into the card edge connector.

2. Description of the Prior Art

U.S. Pat. No. 4,553,804 issued to Scott et al. on Nov. 19, 1985, discloses a related conventional card edge connector. The card edge connector comprises an elongated outer housing having a channel extending in a longitudinal direction, a plurality of contacts mounted on said outer housing on either side of said channel, said contacts having lower end portions projecting exteriorly of said outer housing through the bottom of said channel, and upper portions interior said outer housing adapted to contact opposite sides of a circuit board, an inner housing mounted interior said outer housing for movement inwardly and outwardly along a vertical direction normal to the longitudinal direction, an ovally shaped cam having an axis of rotation extending in the longitudinal direction, said cam being adapted to be rotated from a first position presenting a narrow cross section in the vertical direction to a second position presenting a wider cross section in the vertical direction, a pair of first cam engaging surfaces and a pair of second cam engaging surfaces, said inner and outer housings each including respective first and second cam engaging surfaces, said first surfaces being diametrically opposed along the vertical direction and adapted to be moved apart when said cam is rotated from said first position, said second surfaces being laterally displaced from said first surfaces along the direction of rotation of said cam and adapted to be moved apart when said cam is rotated from said second position, said inner housing including means adapted to engage and urge upper portions of said contacts apart when said cam is rotated from one of said positions to the other of said positions whereby removal or insertion of a circuit board is permitted.

However, when the cam is rotated from one of the positions to the other of the positions, a force is applied to the inner housing which may cause imbalance of the inner housing. Furthermore, there is no sealing protection for contact mating portions of the contacts when PCB is not installed.

Hence, an improved card edge connector is needed to solve the above problems.

OBJECTS OF THE INVENTION

A main object of the present invention is to provide a card edge connector which provides physical sealing to contact mating faces of the contacts, anytime that a PCB is not installed.

Another object of the present invention is to provide a card edge connector having contacts whose Contact durability is improved.

Another object of the present invention is to provide a card edge connector providing a reducing insertion force by approximately 40% when a daughter card is inserted in.

Still another object of the present invention is to provide a card edge connector which provides 100% contact normal force only at the end of PCB insertion.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
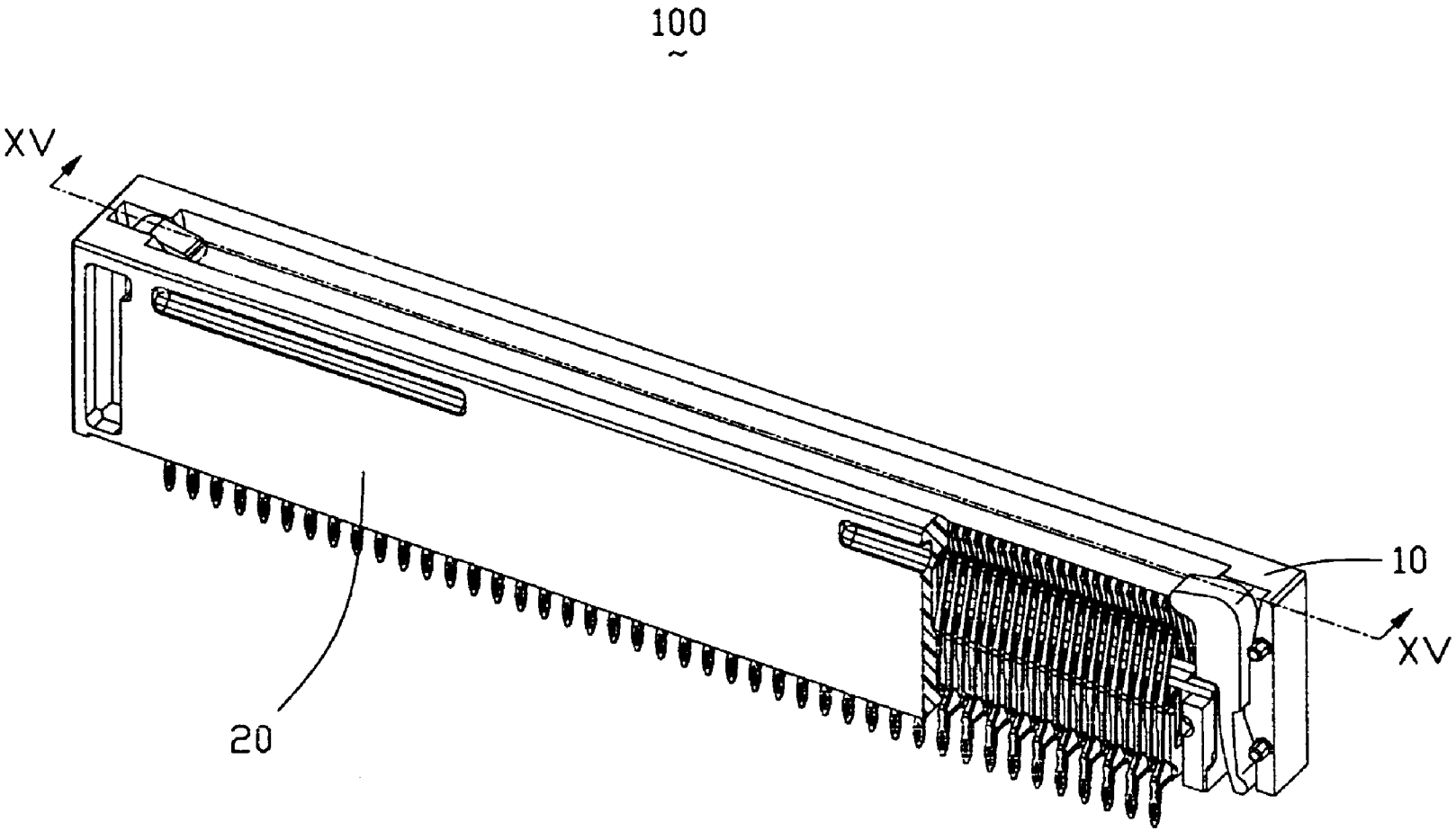
FIG. 1 is a perspective view of a card edge connector of an embodiment according to the present invention, with a part of a housing half cut off.

Reference will now be made to the drawing figures to describe the present invention in detail.

Figure 2:
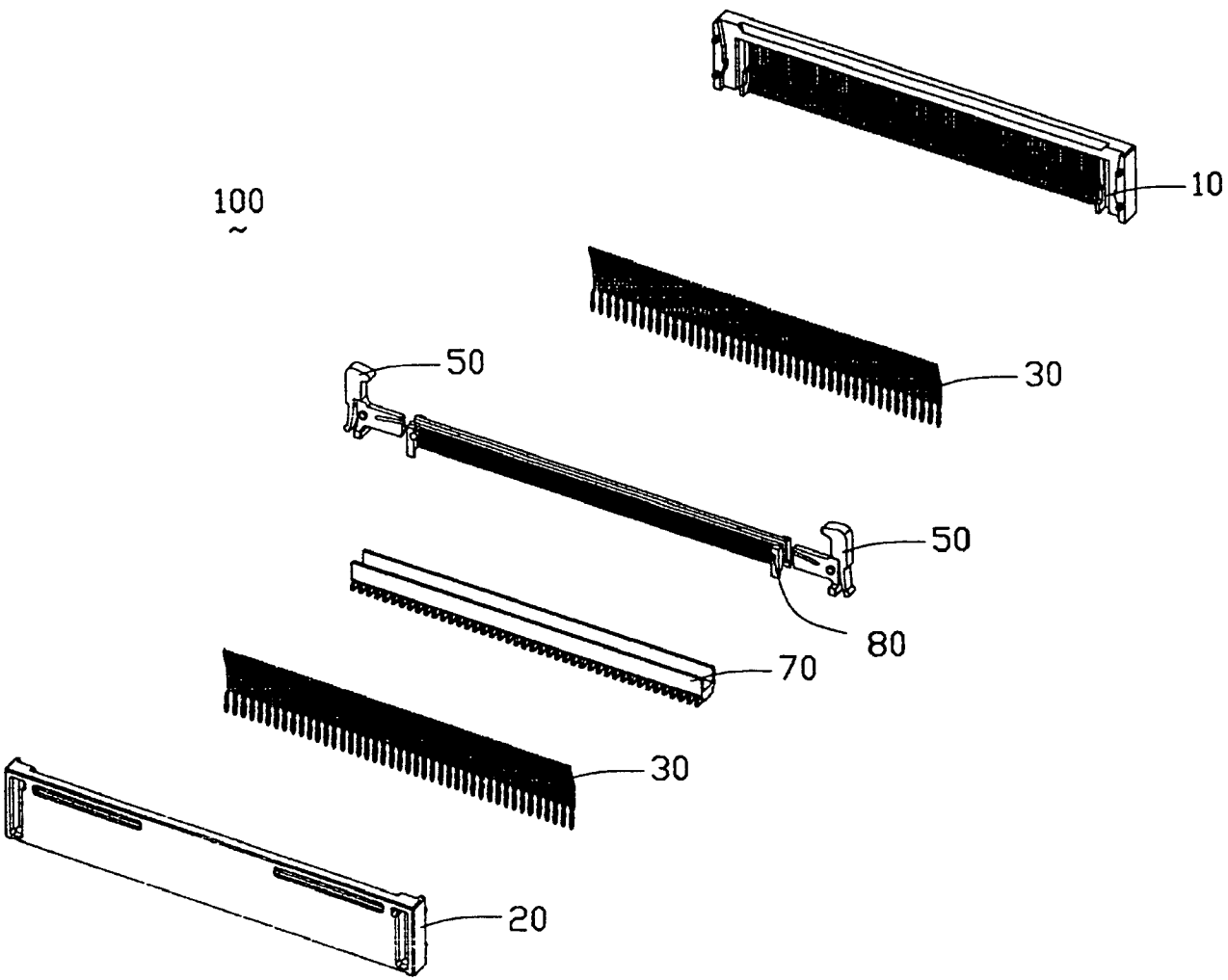
FIG. 2 is an exploded view of a card edge connector shown in FIG. 1.
Figure 10:
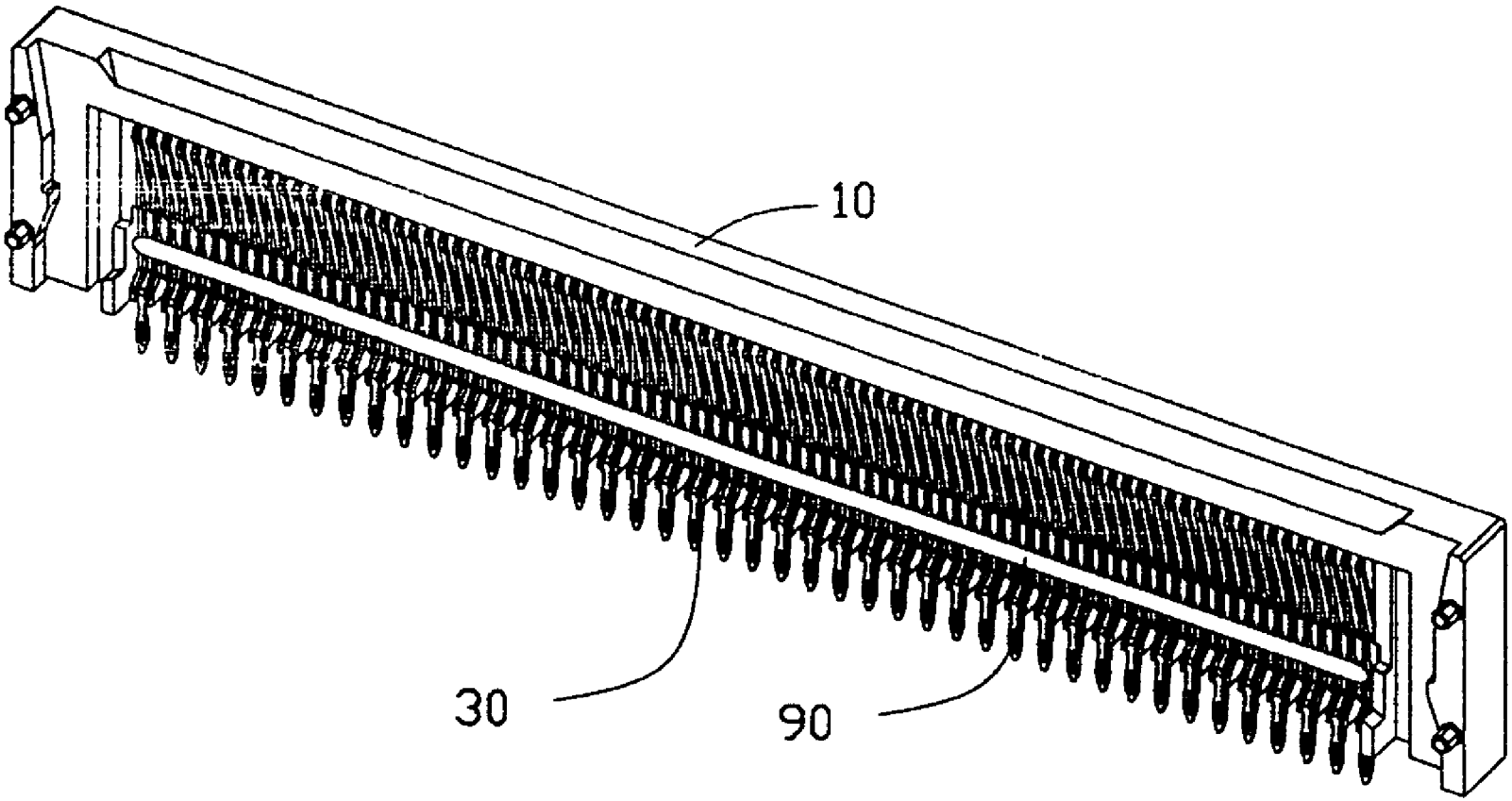
FIG. 10 is a perspective view of the subassembly shown in FIG. 9 with a piece of epoxy bead applied onto the contact strip.
Figure 11:
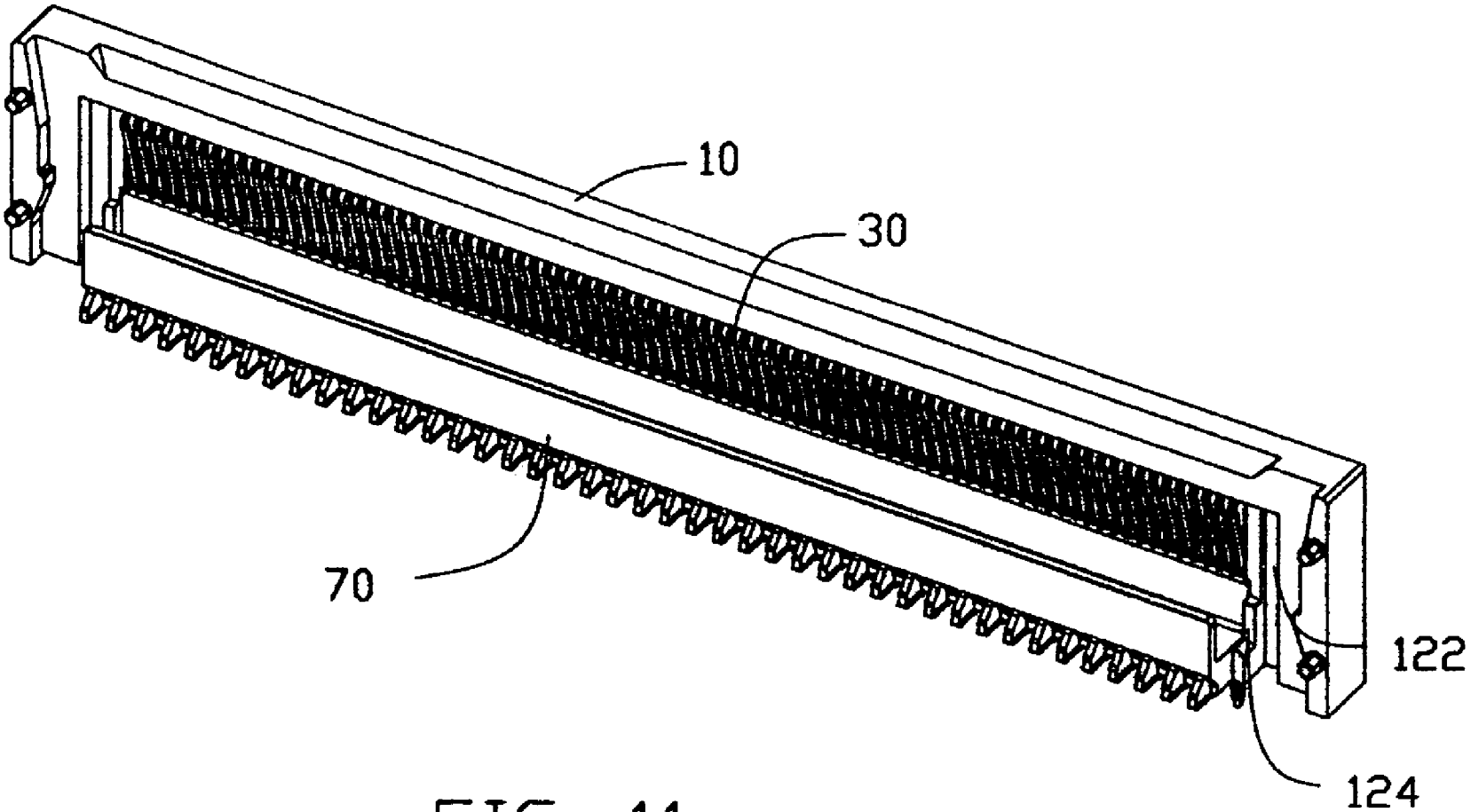
FIG. 11 is a perspective view of the subassembly shown in FIG. 10 with the center bar is disposed thereon.
Figure 12:
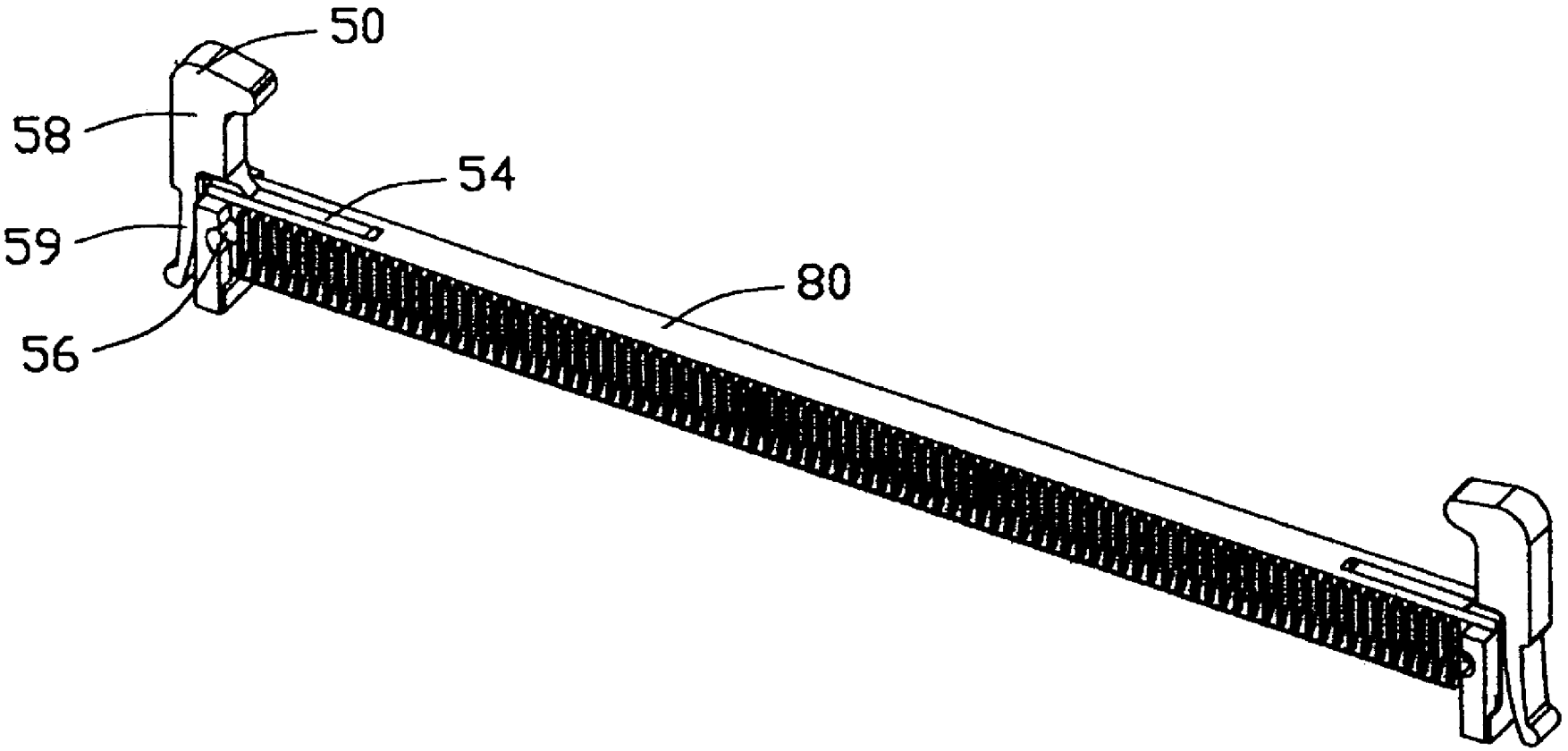
FIG. 12 is a perspective view of a carriage subassembly of the molded carriage shown in FIG. 5 and the latch/release arm shown in FIG. 6.
Figure 13:
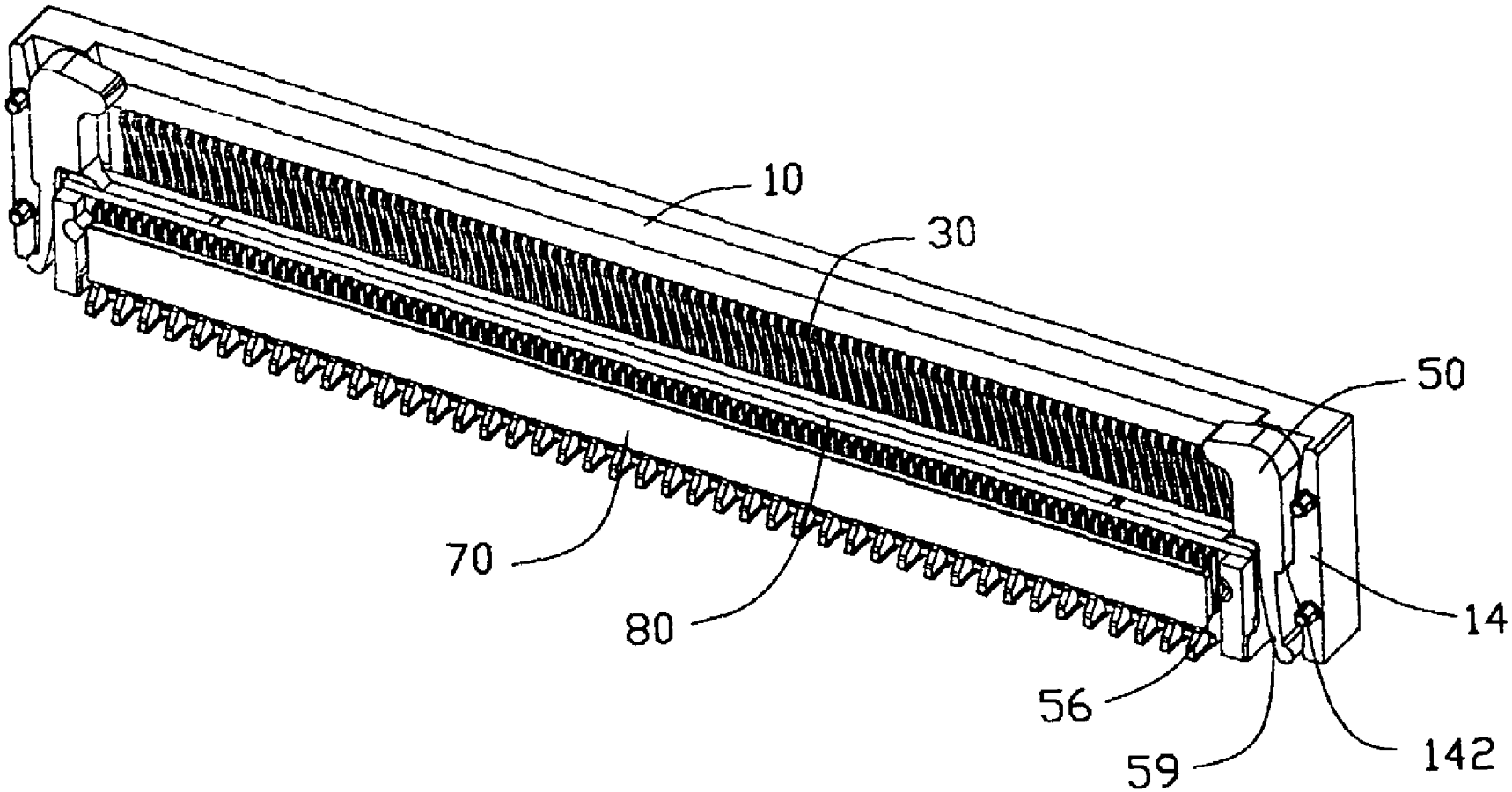
FIG. 13 is a perspective view of the subassembly shown in FIG. 11 with the carriage subassembly in position.
Figure 14:
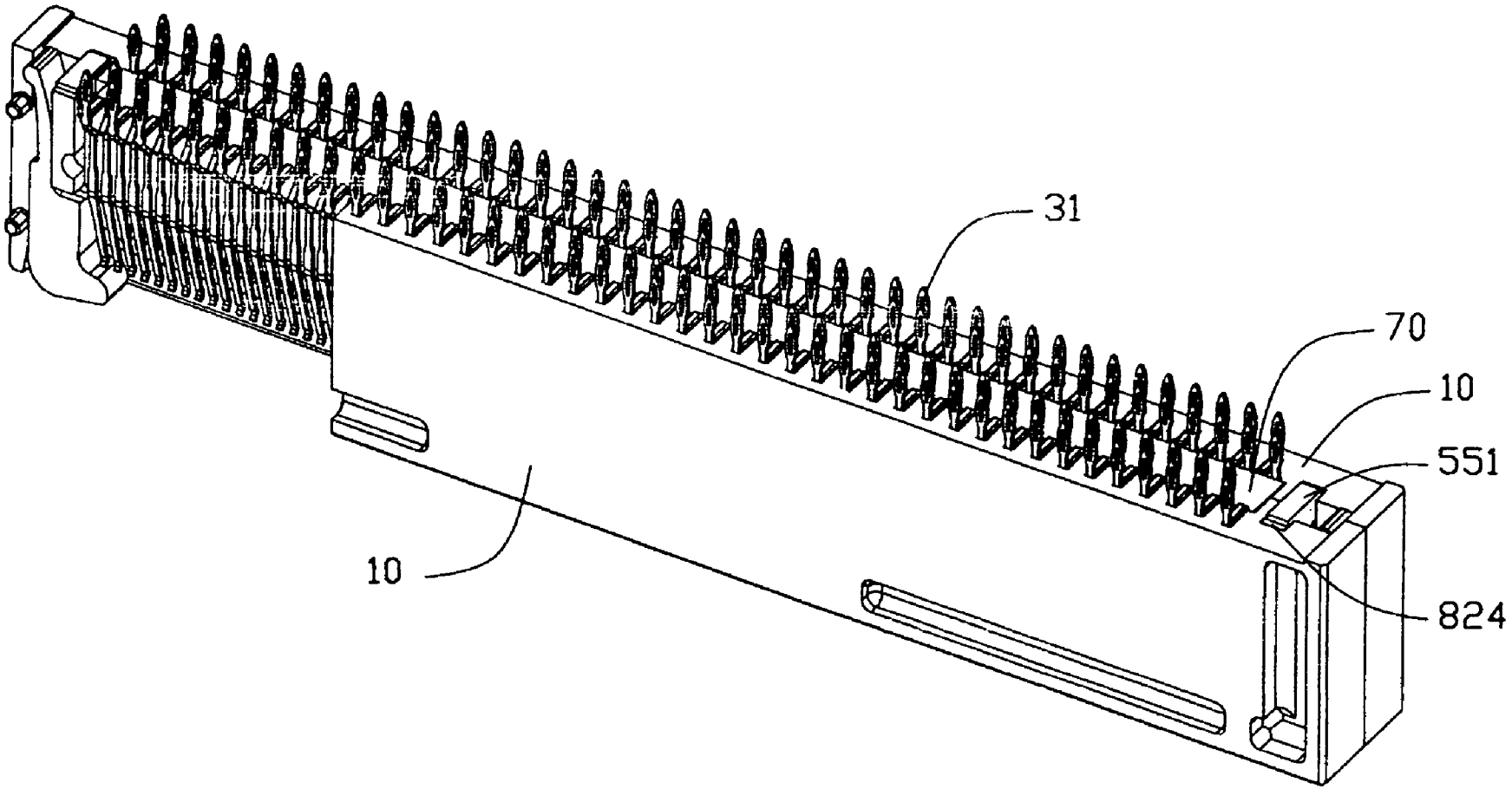
FIG. 14 is another perspective view of a final assembly connector shown in FIG. 1.

Referring to FIGS. 1-2, a card edge connector 100 of an embodiment according to the present invention is shown. The connector 100 is formed as an elongated and narrow body which defines a lengthwise direction, a widthwise direction perpendicular to the lengthwise direction and a vertical direction orthogonal to both the aforementioned directions. The connector 100 includes two elongated molded housing halves 10 and 20 cooperatively forming the body of the connector 100, two contact strips 30 arranged along the lengthwise direction of the molded housing halves 10 and 20, two molded latch arms 50, a molded center bar 70, a molded carriage 80 and two pieces of epoxy beads 90 (shown in FIG. 10).

Figure 3:
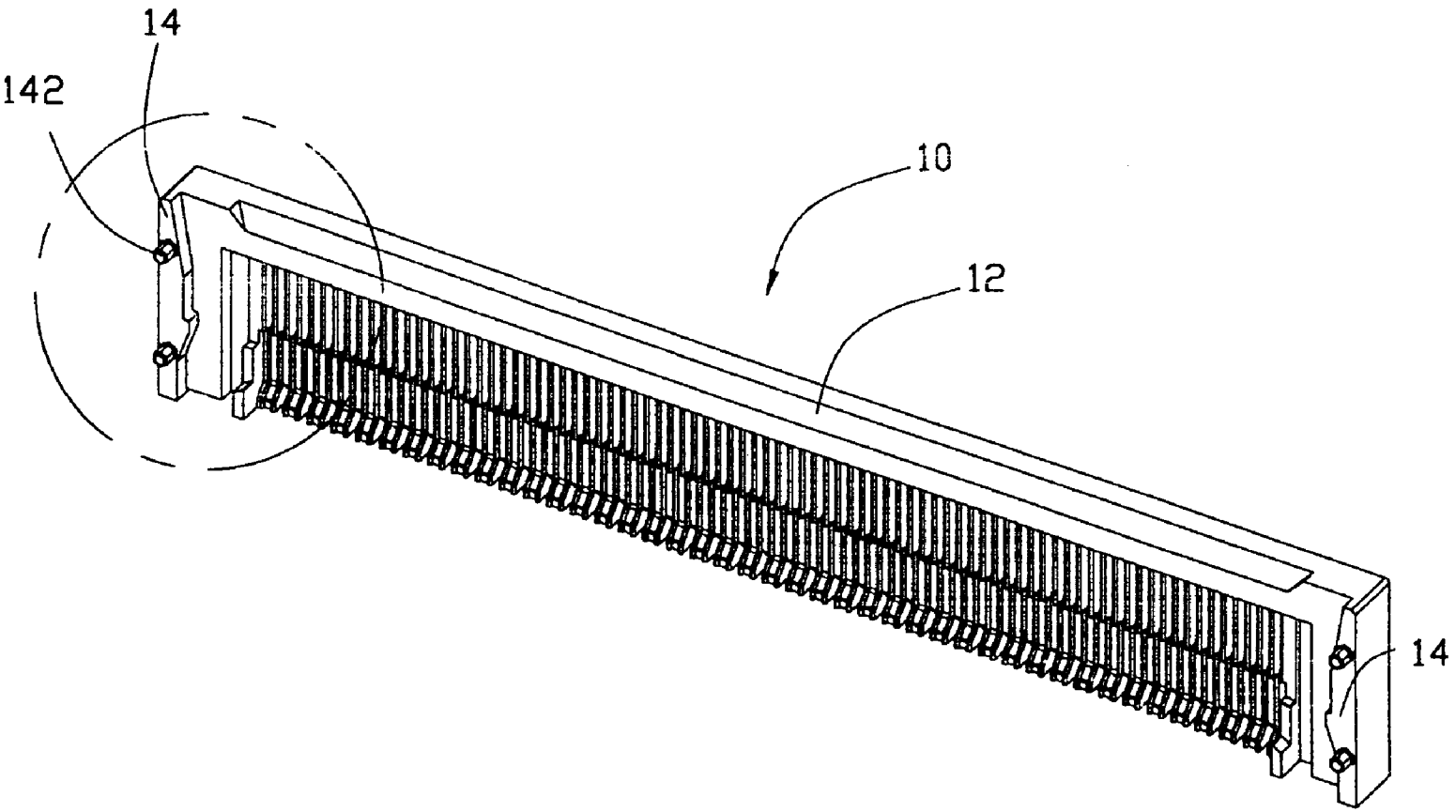
FIG. 3 is a perspective view of a housing half shown in FIG. 2.
Figure 4:
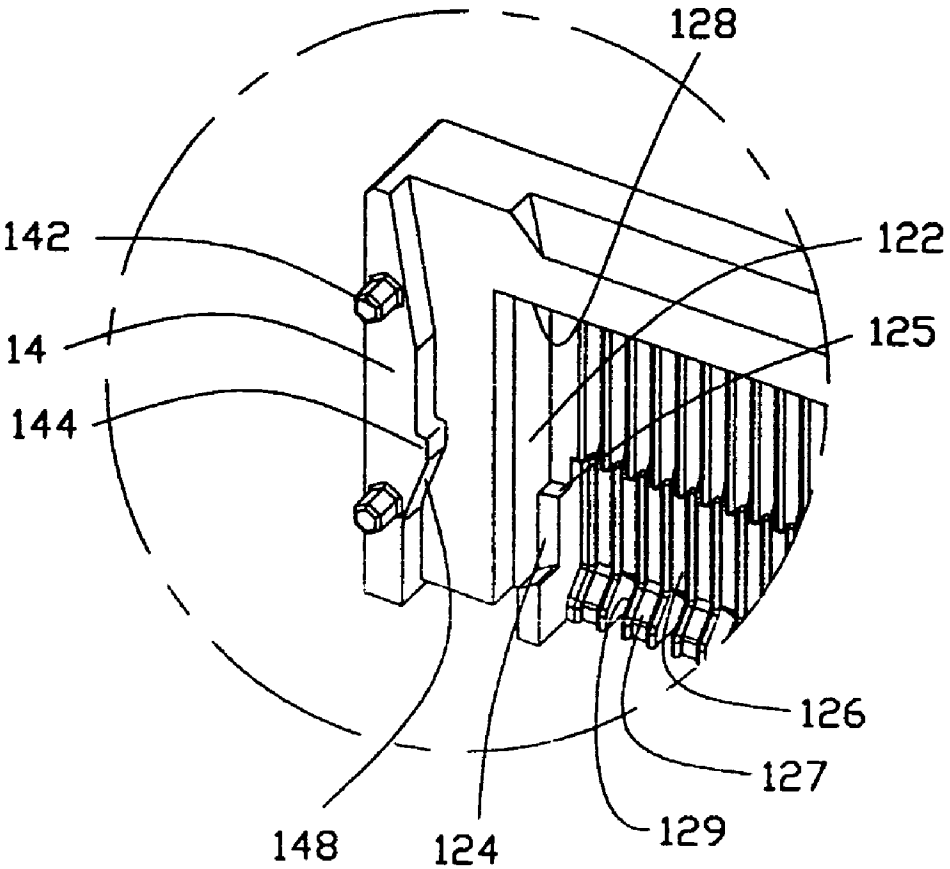
FIG. 4 is a scaled perspective view of the housing half shown in FIG. 3.

Referring to FIGS. 3-4, the molded housing half 10 is shown. The housing half 10 forms a long sidewall 12 and two end walls 14 perpendicularly extending from opposite ends of the sidewall 12, which cooperatively define a center slot (not labeled) for receiving the two molded latch arms 50, the molded center bar 70, the molded carriage 80 and an inserted card 400 (shown in FIG. 17). The sidewall 12 defines a row of contact receiving slots 126 for receiving the contact strips 30 and a pair of guiding grooves 122 at opposite ends of the row of contact receiving slots 126. The guiding groove 122 extends in the vertical direction and ends in a stop surface 128 facing downwardly. The sidewall 12 further forms a respective resting tab 124 and a number of fingers 127. Each of the resting tabs 124 is located between one of the guiding grooves 122 and the nearest contact receiving slot 126 and defines a resting surface 125 facing upwardly. The fingers 127 correspond to lower ends of every other contact receiving slots 126 so that, between every two adjacent fingers, a respective recessed lower end portion 129 of the slot 126 is formed. Each of the end walls 14 protrudes inwardly a cam protrusion 144 having a slope cam surface 148 facing the center slot and extending outwardly and downwardly. The end wall 14 forms a vertical end face and a pair of guiding posts 142 protruding in the width direction therefrom.

The other housing half 20 is the same as the housing half 10 except that a pair of guiding holes (not shown) takes the places of the guiding posts 142.

Figure 5:
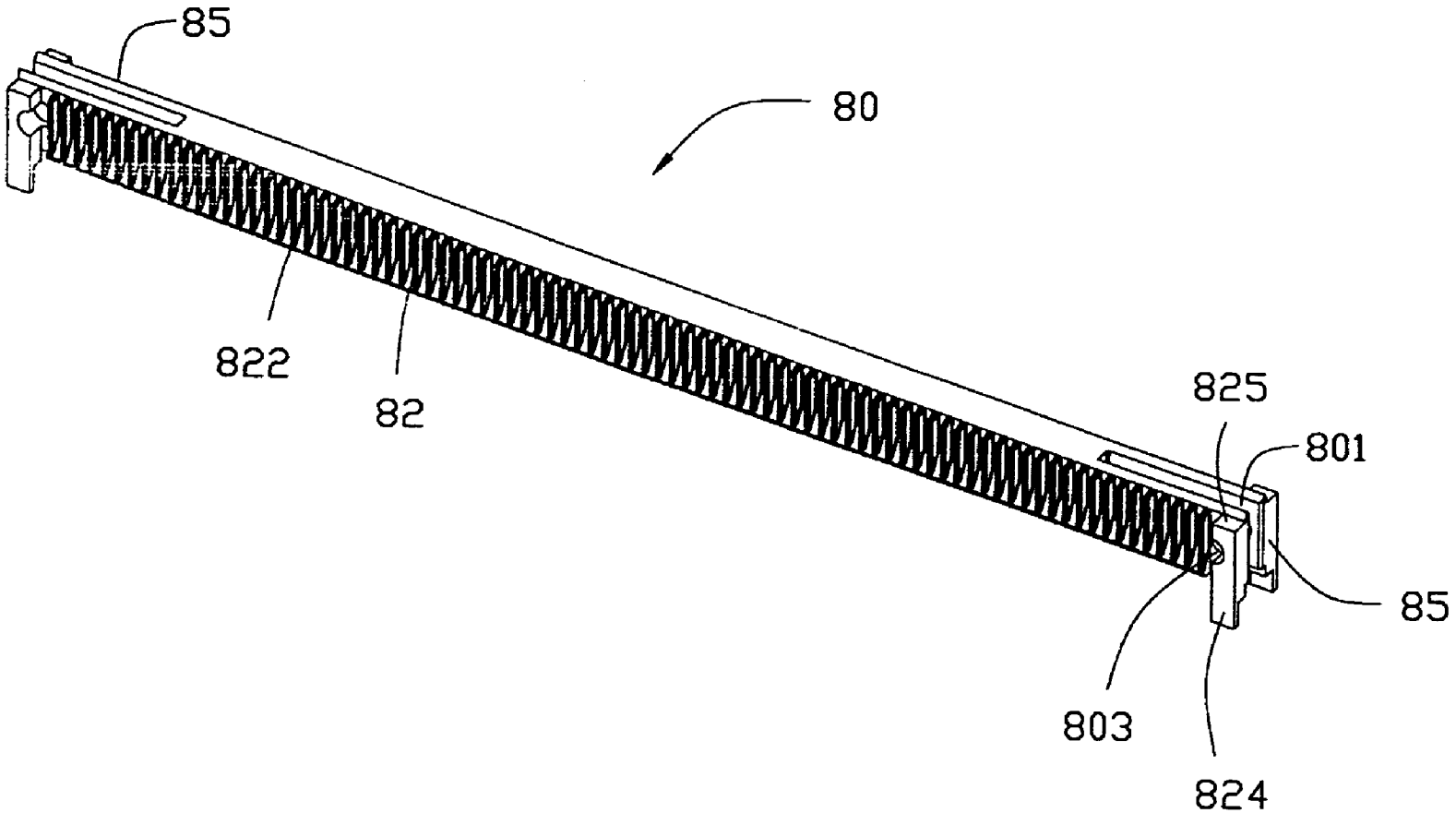
FIG. 5 is a perspective view of a molded carriage shown in FIG. 2.

Referring to FIG. 5, the molded carriage 80 is shown as an elongated element parallel to the lengthwise direction. The molded carriage 80 defines a pair of opposite side faces 82 and a row of guiding slots 822 extending vertically in a center portion of either side face 82 and forms a pair of guiding towers 824 at two opposite ends. The rows of guiding slots 822 of the molded carriage 80 is corresponding to the rows of contact receiving slots 126 of the molded housing halves 10 and 20 for guiding or retaining the contact strips 30. Each end of the elongated element 80 defines an opening 801 cutting through in the vertical direction so that two parallel branch boards 85 are formed. The branch boards 85 are flexible and each board defines a circular hole 803 near the opposite ends.

Figure 6:
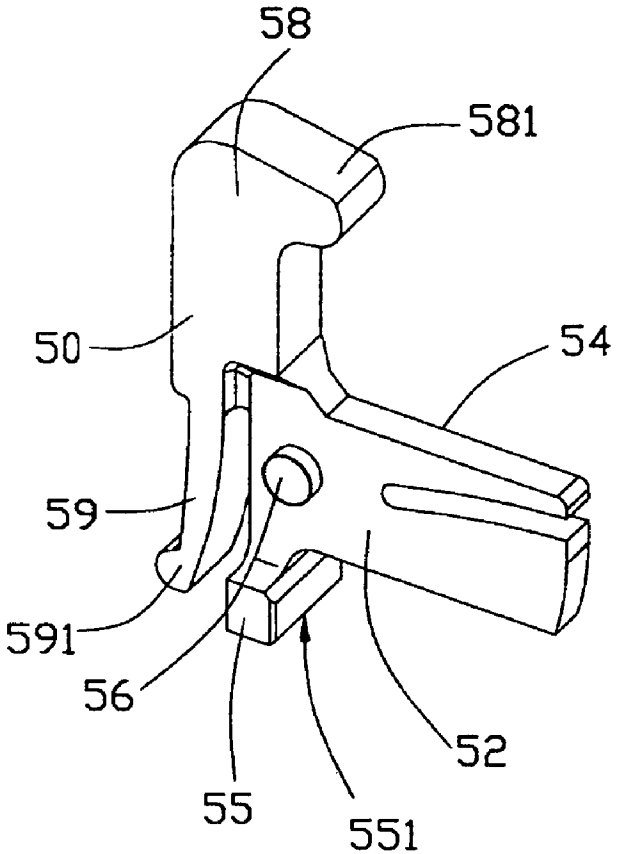
FIG. 6 is a perspective view of a latch/release arm shown in FIG. 2.

FIG. 6 is a perspective view of the latch/release arm 50. The latch/release arm 50 includes a base board 52 perpendicular to the width direction, a pair of pivot shafts 56 projecting along the width direction from the base board 52, a flexible spring-finger 54 extending horizontally from the base board 52, a tab 55 connected to a bottom portion of the base board 52, an upper latch arm 58 extending upwardly from the base board 52, a latch-arm kicker spring 59 extending downwardly from a lower end of the upper latch arm 58. The tab 55 defines a surface or edge 551 facing downwardly. The upper latch arm 58 protrudes an inward nose 581 for mating into a cutout 40 defined in the inserted PCB 400. The latch-arm kicker spring 59 is a cantilever structure and forms an outwardly slanted end 591.

Figure 7:
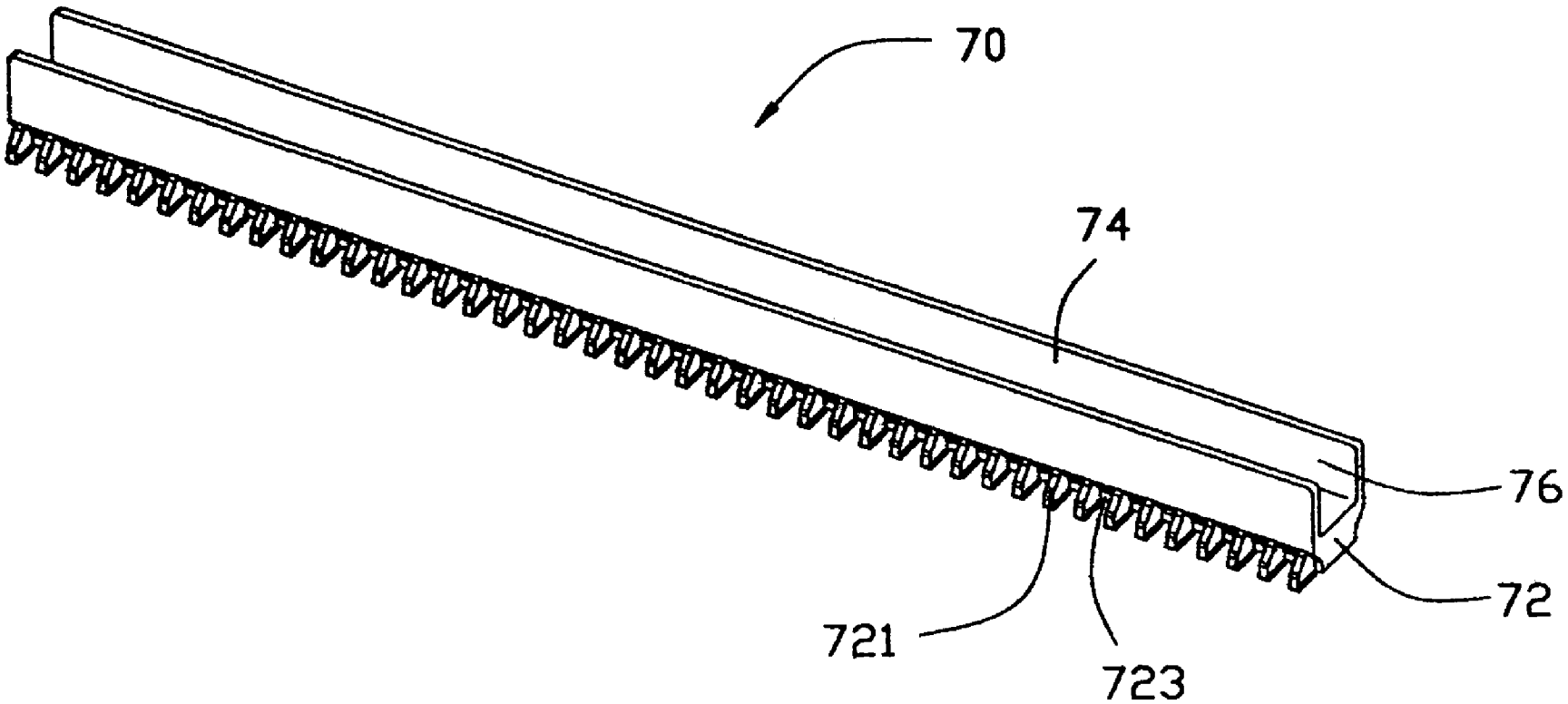
FIG. 7 is a perspective view of a center bar shown in FIG. 2.

Referring to FIG. 7, the molded center bar 70 is shown as an elongated component. The molded center bar 70 forms a bottom wall 72 and a pair of lateral walls 74 connected to opposite sides of the bottom wall 72, and thus a through U-shaped slot 76 is defined. The center bar 70 also has on both sides thereof a number of fingers 721 and slots 723 respectively corresponding to the slots 126 and the fingers 127 of the molded housing halves 10 and 20.

Figure 8:
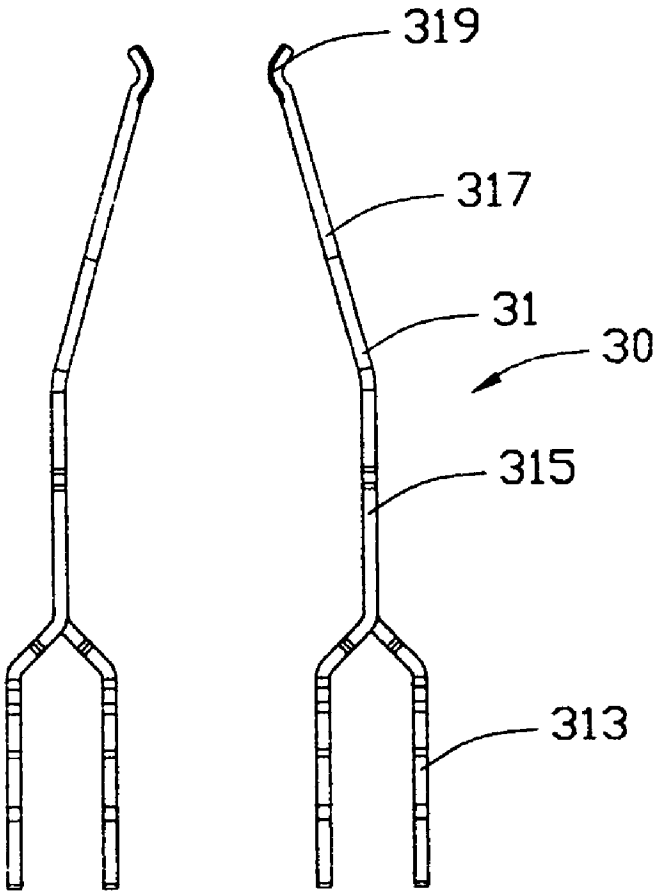
FIG. 8 is a side view of a contact strip in FIG. 2.
Figure 9:
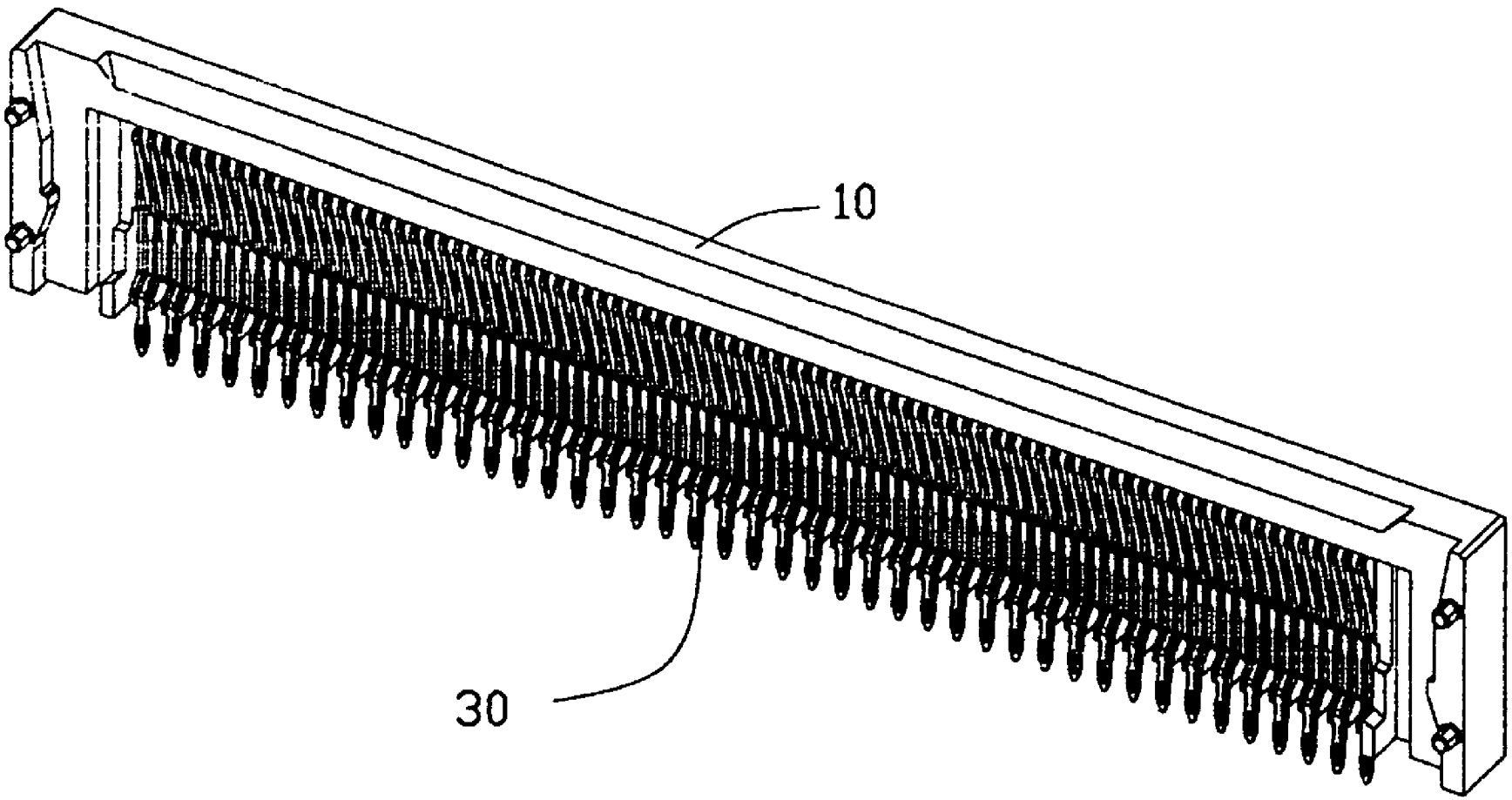
FIG. 9 is a perspective view of the housing half shown in FIG. 3, with a contact strip arranged therein.

Referring to FIG. 8, the contact strips 30 are shown. Each of the contacts 31 forms an intermediate securing portion 315 for securing the contact 50 to the molded housing halves 10, a terminal portion 313 extending downwardly from the securing portion 315 for press fitting into through holes defined in a mother PCB, a slanted cantilever 317 extending upwardly from the securing portion 315 and a contacting portion 319 formed near an end of the cantilever 317.

The pieces of epoxy beads 90 are made of a kind of epoxy-ester that can be purchased as commercial item.

Referring to FIGS. 1 and 9-14, in process of assembly of the connector 100, the two contact strips 30 are firstly respectively disposed into the contact receiving slots 126 of the molded housing halves 10 and 20, with the slanted cantilever 317 leaning away from the sidewall 12. Secondly, two pieces of epoxy beads 90 are respectively applied across the entire rows of the contacts 30. Thirdly, the center bar 70 is jogged onto the epoxy bead 90 of one subassembly from the second step and the center bar 70 is so dimensioned that it snugly fits between the resting tabs 124 of the molded housing half 10,20. Fourthly, the latch/release arms 50 are oriented with respect to ends of the carriage 80 and then pushed into the openings 801 of the carriage 80 so that the pivot shafts 56 snap into the circular holes 803 of the carriage 80 and the latch/release arms 50 are rotatably assembled to the carriage 80. Fifthly, the carriage subassembly from the fourth step is placed into the U-shaped slot 76 of the center bar 70 with two opposite ends of the carriage 80 disposed beyond the corresponding ends of the center bar. At this moment, the guiding towers 824 of the carriage 80 respectively engage into the guiding grooves 122 and the tabs 55 are kept aligned with the guiding grooves 122 by the resting tabs 124. Sixthly, the subassembly from the second step is combined with the subassembly from the fifthly step so that the epoxy beads 90 are compressed and distributed between the strips of contacts 30 and plastic components of the housing. During this step, the guiding posts 142 and the guiding holes 122 of the housing halves 10 and 20 provide preliminary alignment. Proper alignment is accomplished by the fingers 721 of the center bar 70 interlacing with the fingers 127 of the housing halves 10 and 20. Finally, the whole assembly is subject to heat, the temperature and length of the heat cycle depending on the selection of epoxy properties, and then is cooled down, resulting in the two housing halves 10 and 20 and the center bar 70 united or bonded together by the epoxy beads 90.

It should be mentioned that before the card edge connector 100 is mounted onto the mother PCB, the carriage subassembly is pushed upwardly till the guiding towers 824 abut the stop surfaces 128 of the housing halves 10 and 20. When the carriage subassembly is moving upwardly in the housing due to engagement between the nose 581 of latch arm 58 and the cut-out 40 of the daughter card 400, the tab 55 rises up to such a level that it is cleared of, and therefore is slidable over, the resting tab 124, aided by the end 591 of the latch-arm kicker spring 59 resiliently pressed against the slope cam surfaces 148 of the cam protrusions 144. When the carriage subassembly is stopped by the stop surfaces 128 of the housing halves 10,20, the tabs 55 of the latch/release arms 50 sliding over the resting tab 124 enables the latch/release arms 50 to rotate outwardly approximately 10 degrees by forces from the cam faces 144 applying to the ends 591 of the latch-arm kicker springs 59. When the carriage assembly is kept in its uppermost position, the contact portions 319 of the contacts 31 rest on the carriage 80 so that they are protected from corrosive effect from the environment, and a card slot defined by the two housing halves 10 and 20 for the daughter card 400 to be inserted into is shuttered and protected from dust intrusion by the carriage 80. Also, in such arrangement, relative sliding movement of the contact portions 319 of the contacts 31 in the slots 822 of the carriage 80 provides a mechanism so that the contact portions 319 can be properly lubricated by the carriage 80 made of an adequately selected material known to person in this art.

Figure 15:
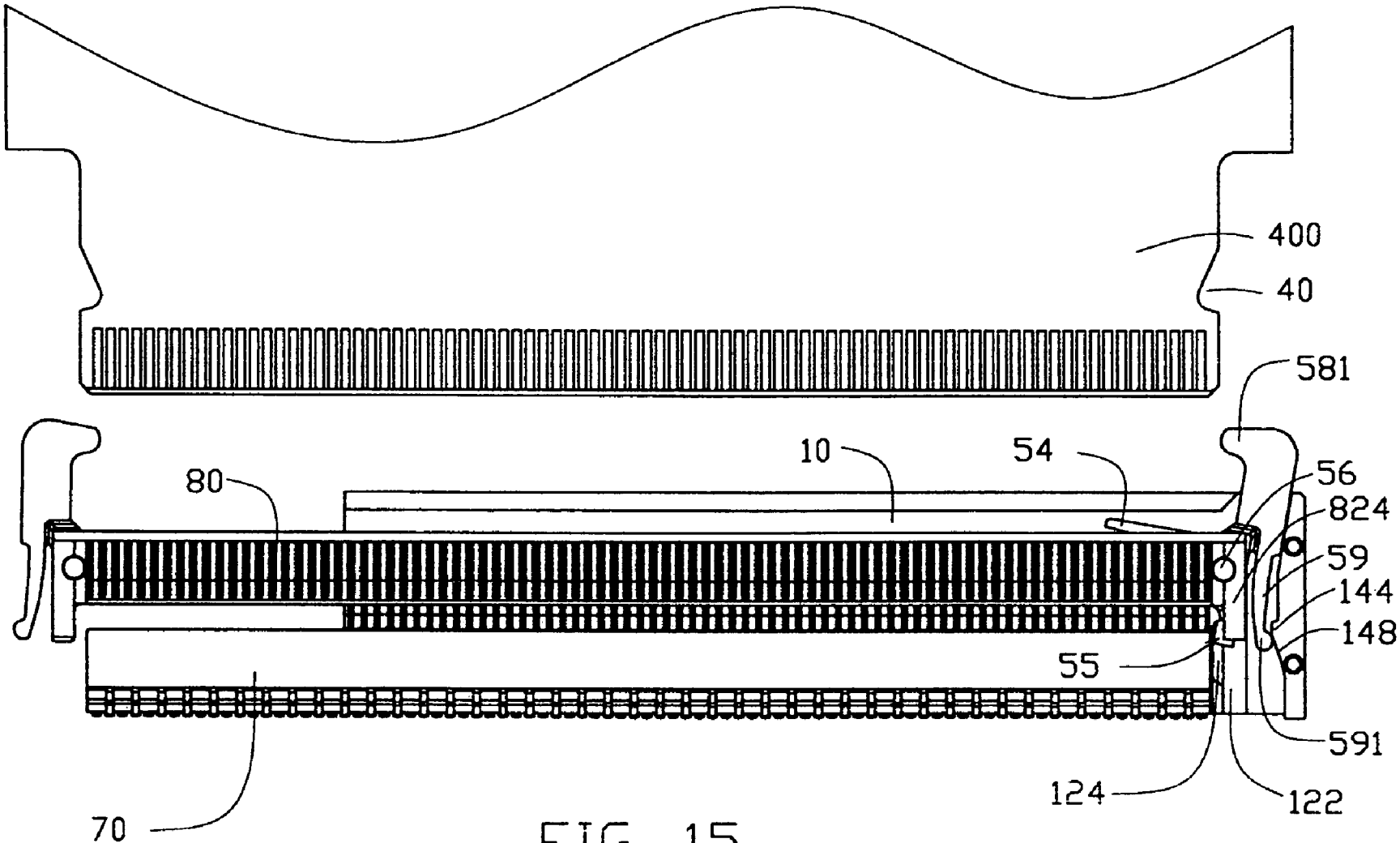
FIG. 15 is a cross sectional view of the card edge connector shown in FIG. 1, taken along a line XV-XV, except that the carriage subassembly arrives at its highest position.
Figure 16:
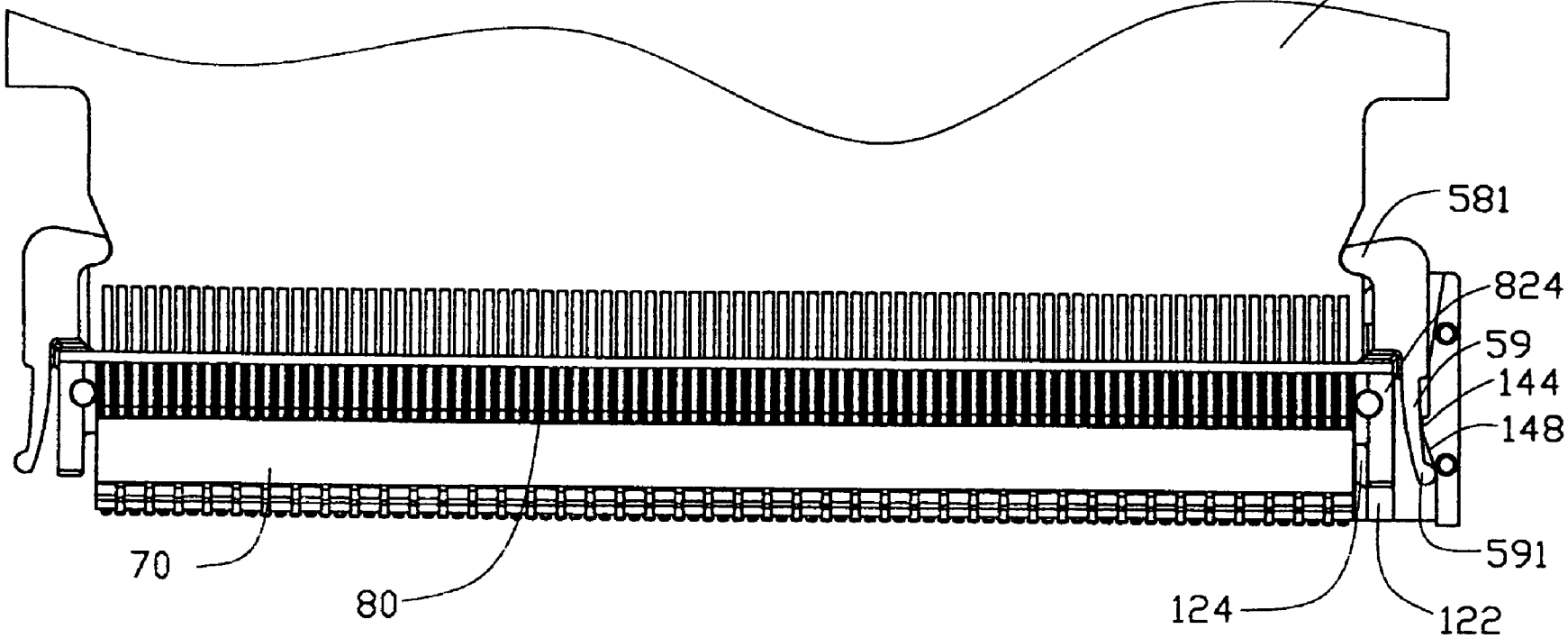
FIG. 16 is a view similar to FIG. 15, except that a PCB is partly inserted therein and the latch/release arms come to a vertical direction.
Figure 17:
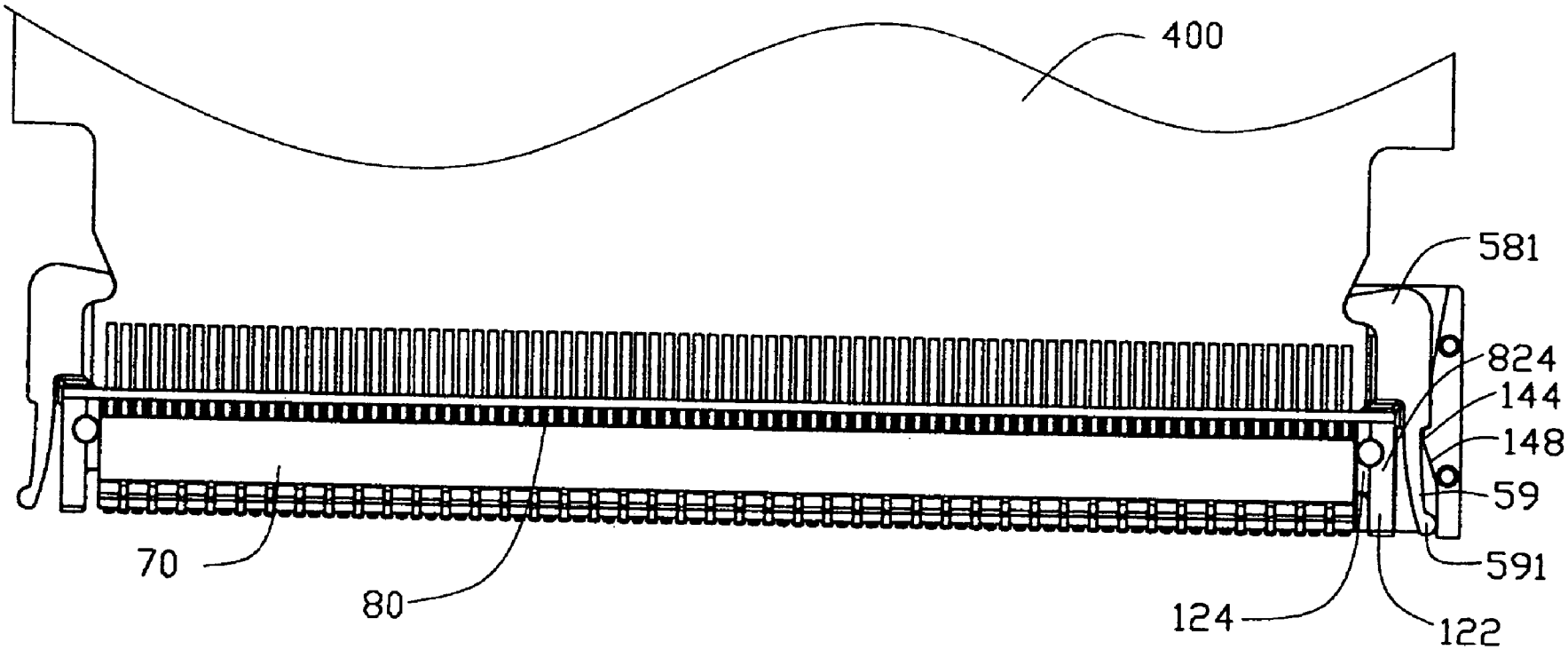
FIG. 17 is a view similar to FIG. 15, except that a PCB is fully inserted thereinto and the carriage subassembly arrives at its lowest position.

Referring to FIG. 15-17, the operation of the preset invention will be described. Initially, the leading edge of the daughter PCB 400 is inserted. The PCB 400 first comes into contact with the flexible spring-fingers 54 of the latch/release arms 50. As these spring fingers 54 of the latch arms 50 are momentarily compressed by the PCB 400, they absorb shock as the latch arms rotate to vertical. The base boards 52 extends below ends of the spring-fingers 54 and fits in the openings 801 of the carriages 80 for guiding the rotations of the latch/release arms 50 and protecting the spring-fingers 54 from excessively deformed when being abruptly pressed by the inserted PCB 400. Cut-outs 40 in the PCB 400 provide pockets for the protruding nose 581 of each latch/release arm 50. As the latch/release arms 50 are moving toward their vertical positions, the latch-arm kicker springs 59 are momentarily compressed against end walls 14 of the connector housing. When the latch/release arms 50 further moves downward to such a position where the surfaces 551 of each latch arm 50 is clear of the resting surfaces 125 of the resting tabs 124 of the housing and are free to move downwardly into the connector 100, the carriage 100 will be carried to move down together therewith. As the carriage 80 travels downward, the contacts 31 drop off from the carriage 80 and onto the pads of the PCB 400. Full contact normal force occurs at this moment along a substantial length of the PCB board's pads.

Removal of the PCB 400 is the reverse of the above. When the carriage subassembly is pulled up by the daughter board 400 far enough to deflect the contacts 31 back out, the latch/release arms 50 are cleared to rotate back out to 10 degrees off of vertical, thereby releasing the PCB 400 from the connector 100 and preparing it for the next insertion of a PCB 400.

By eliminating the abrupt transition that typically occurs between the connector 100 and the PCB 400 during mating and unmating, the invention extends the durability and reliability of the PCB 400 and the connector 400, improves signal integrity by reducing the physical length of contact (as a long lead-in ramp on the contacts is no longer required), reduces the force transmitted to the backplane board during insertion of the card-edge PCB 400 by approximately half, and provides corrosion/contamination protection to the contact interfaces whether or not a PCB is installed.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

We claim:

1. An electrical connector comprising:

a housing assembly defining a slot;

a plurality of contacts assembled to the housing assembly;

a carriage up and down moveably assembled in the slot; and a latch arm being pivotally mounted to an end of the carriage and being up and down moveable with the carriage, the latch arm being pivotally moveable coupled with a downward movement together with the carriage, in response to insertion of a daughter card into the slot, from an upper position to a lower position; and wherein the latch arm comprises a lower base portion and an upper flexible finger for extending into the slot.

2. The electrical connector as recited in claim 1, wherein the latch arm comprises a tab and a resilient portion urging against a first wall portion of the housing assembly to present the tab immediate above a second wall portion of the housing assembly so as to prevent the latch arm from a downward movement without pivoting the latch arm when the latch arm is at the upper position.

3. The electrical connector as recited in claim 1, wherein the latch arm comprises a nose for engaging into a cutout of an inserted daughter card when the latch arm is at the lower position, the nose preventing the latch arm from a pivotal movement without upwardly moving the latch arm.

4. The electrical connector as recited in claim 1, wherein the finger of the latch arm is substantially leveled with an upper face of the carriage when the latch arm is at the lower position.

5. The electrical connector as recited in claim 1, wherein the carriage comprises an end opening receiving the base portion and the flexible finger of the latch arm.

6. The electrical connector as recited in claim 1, wherein the carriage comprises a plurality of guiding slots on a side surface thereof for receiving the contacts.

7. The electrical connector as recited in claim 6, wherein the contacts are arranged in two rows on opposite sides of the carriage, and the carriage urges the two contact rows away from each other when the carriage is at an upper position corresponding to the upper position of the latch arm.

8. The electrical connector as recited in claim 1, wherein the housing assembly comprises two side housing halves and a center bar cooperatively clamping the contacts therebetween.

9. The electrical connector as recited in claim 8, wherein the housing half comprises a sidewall defining a plurality of contact receiving slots.

10. The electrical connector as recited in claim 8, wherein:

the center bar comprises a bottom wall, a pair of lateral walls, and a plurality of alternating fingers and slots; and the housing half comprises a plurality of alternating slots and fingers engaging with the fingers and slots of the center bar, respectively.

11. A card edge connector comprising:

an insulative housing defining a slot with at least one row of passageways located by one side of said slot;

a plurality of contacts disposed in the corresponding passageways, respectively; and a carriage up and down moveably assembled into the central slot, said carriage defining associatively at least one moveable latch/release arm at one end; wherein said latch/release arm performs an unlocked manner when said carriage is located in an upper position with regard to the housing, and a locked manner when said carrier is located in a lower position; and wherein the latch arm comprises a lower base portion and an upper flexible finger for extending into the slot.

12. A card edge connector comprising:

an insulative housing defining a slot with at least one row of passageways located one side of said slot;

a plurality of contacts disposed in the corresponding passageways, respectively; and a carriage up and down moveably assembled into the central slot, said carriage defining associatively at least one moveable latch/release arm at one end with a locking head thereof; wherein at least one of said housing and said carriage defines a guiding device to forcibly urge the locking head of the latch/release arm to move inwardly for locking or outwardly for releasing; and wherein the latch/release arm comprises a lower base portion and an upper flexible finger for extending into the slot.

* * * * *